US006082030A

United States Patent [19]

Kesselring et al.

[11] Patent Number: 6,082,030

[45] Date of Patent: Jul. 4, 2000

[54] BEVERAGE CAN IDENTIFICATION SYSTEM

[76] Inventors: Valarie Lyn Kesselring, 4180 Trout Ave., Milton, Fla. 32583; Margaret Caine, 501 S. 7th St., Pekin, Ill. 61554

[21] Appl. No.: 09/130,355

[22] Filed: Aug. 6, 1998

[51] Int. Cl.[7] ..... G09F 3/00; G09F 3/16; G09F 3/08

[52] U.S. Cl. ..... 40/307; 40/666; 40/667; 24/429; 24/615

[58] Field of Search ..... 40/299.01, 307, 40/311, 313, 359, 641, 666, 667, 673; 220/258, 259, 269, 906; 206/459.5; 215/230; 24/419, 429, 615

[56] References Cited

U.S. PATENT DOCUMENTS

| | | | |
|---|---|---|---|
| 3,075,269 | 1/1963 | Simberg | 24/419 |
| 3,225,469 | 12/1965 | Chase | 40/641 |
| 3,822,496 | 7/1974 | Minder | 40/307 |
| 3,958,354 | 5/1976 | Hough et al. | 40/307 |
| 4,660,446 | 4/1987 | Soltis | 81/3.55 |
| 4,762,229 | 8/1988 | Wickre | 206/459 |
| 5,191,979 | 3/1993 | Nemeroff | 206/459.5 |
| 5,251,758 | 10/1993 | Kolacek | 206/542 |
| 5,301,802 | 4/1994 | Nemeroff | 206/217 |
| 5,377,853 | 1/1995 | Papciak | 215/230 |
| 5,441,182 | 8/1995 | Sullivan | 40/322 X |
| 5,529,179 | 6/1996 | Hanson | 206/219 |
| 5,799,815 | 9/1998 | Lang | 40/307 X |

FOREIGN PATENT DOCUMENTS

| | | | |
|---|---|---|---|
| 2453614 | 12/1980 | France | 24/429 |

*Primary Examiner*—Brian K. Green
*Attorney, Agent, or Firm*—Joseph N. Breaux

[57] ABSTRACT

An identifier tag for identifying the owner of a beverage can having a beverage can top equipped with a lever tab with a gripping end having a gripping end tab aperture formed therein, and a securing rivet securing an affixed end of the lever tab to the beverage can top. The identifier tag includes at least one identifier tab cover that is securable to the gripping end of the lever tab and includes an identifier tab cover including a molded plastic cover member and a lever tab locking structure. The molded plastic cover member has a lever tab insertion opening formed therein in connection with a lever tab receiving cavity sized to receive the gripping end of the lever tab. An outer top surface of the cover member is provided with an erasable marking surface. The lever tab locking structure includes a resilient locking prong retraction member and a curved locking prong. The resilient locking prong retraction member includes a horizontal portion and a vertical portion.

8 Claims, 3 Drawing Sheets

FIG.3
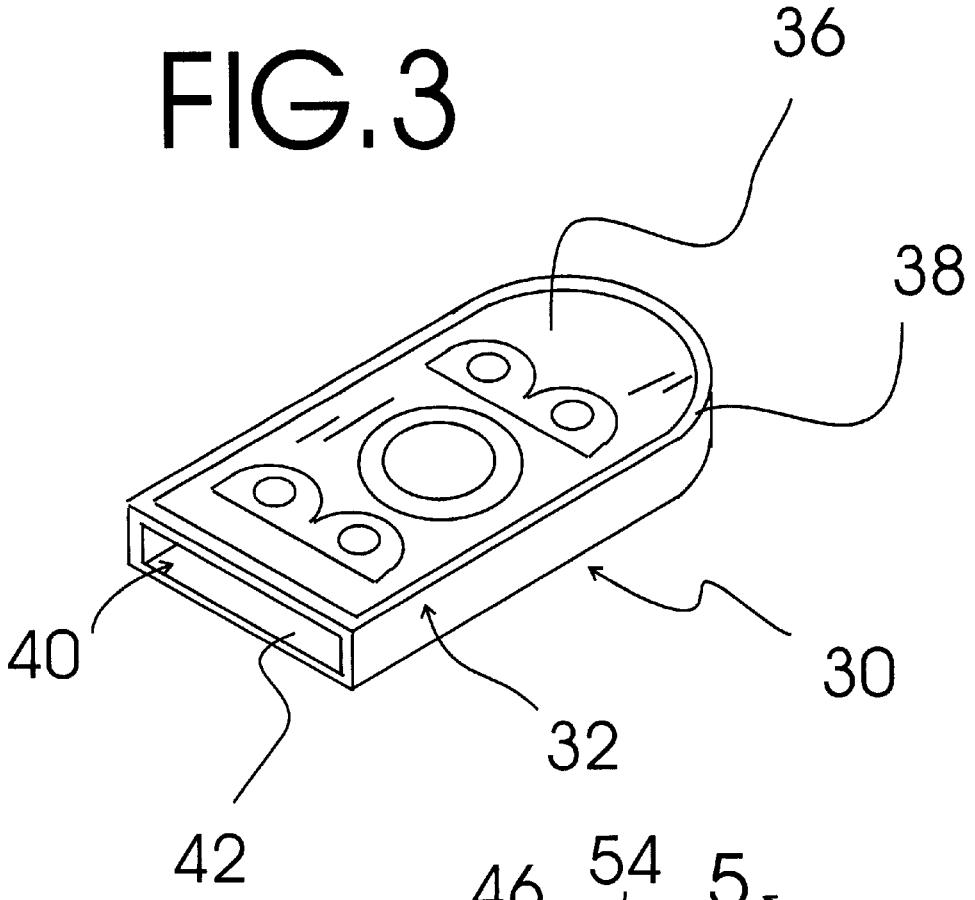
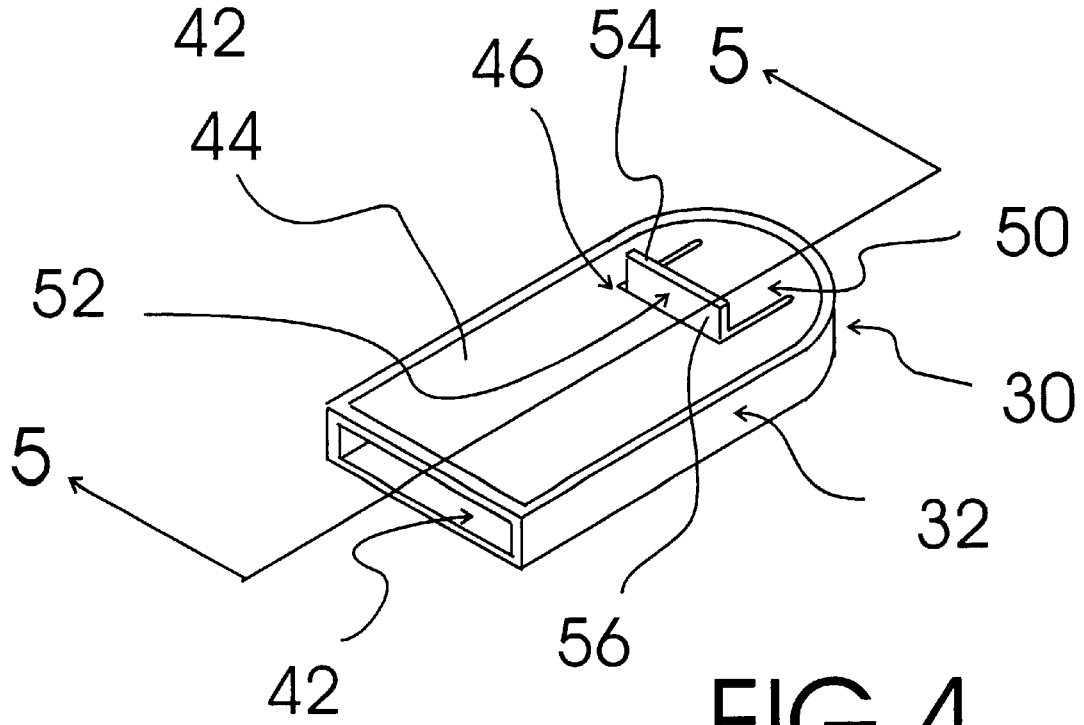
FIG.4

BEVERAGE CAN IDENTIFICATION SYSTEM

TECHNICAL FIELD

The present invention relates to identifying devices and systems and more particularly to beverage can identification system for identifying the owner of a beverage can having a beverage can top equipped with a lever tab with a gripping end having a gripping end tab aperture formed therein, and a securing rivet securing an affixed end of the lever tab to the beverage can top; the beverage can identification system including at least one identifier tab cover that is securable to the gripping end of the lever tab; the identifier tab cover including a molded plastic cover member and a lever tab locking structure; the molded plastic cover member having a lever tab insertion opening formed therein in connection with a lever tab receiving cavity sized to receive the gripping end of the lever tab, an outer top surface upon which an erasable marking surface is formed, and an under surface into which a retraction member opening is formed; the lever tab locking structure including a resilient locking prong retraction member and a curved locking prong; the resilient locking prong retraction member including a horizontal portion and a vertical portion; the horizontal portion extending into the retraction member opening formed into the under surface of the cover member; the vertical portion extending vertically away from the horizontal portion; the curved locking prong arching into the lever tab receiving cavity and away from the lever tab insertion opening; the resilient locking prong retraction member being bendable outwardly from the cover member sufficiently to withdraw the curved locking prong from the lever tab receiving cavity.

BACKGROUND ART

It can be difficult at parties and other social events to identify a particular beverage can from amongst the multitude of identical beverage cans. As a result, many individuals choose to obtain a new drink each time the prospect of identifying their current beverage can has been abandoned. This can result in high level of beverage waste at these kinds at events. It would be a benefit, therefore, to provide an identification system whereby a individuals at large social events can identity as his/her own a particular beverage can from amongst other similar or identical beverage cans. Because an individual may consume more than one canned beverage during a social event, it would be a further benefit to have a beverage can identification system that could be used by the individual to identify his/her beverage can as each new beverage can is obtained.

GENERAL SUMMARY DISCUSSION OF INVENTION

It is thus an object of the invention to provide a beverage can identification system.

It is a further object of the invention to provide a beverage can identification system that can be removed from a beverage can and transferred to successive beverage cans as required.

It is a still further object of the invention to provide a beverage can identification system for identifying the owner of a beverage can having a beverage can top equipped with a lever tab with a gripping end having a gripping end tab aperture formed therein, and a securing rivet securing an affixed end of the lever tab to the beverage can top wherein the beverage can identification system includes at least one identifier tab cover that is securable to the gripping end of the lever tab; the identifier tab cover including a molded plastic cover member and a lever tab locking structure; the molded plastic cover member having a lever tab insertion opening formed therein in connection with a lever tab receiving cavity sized to receive the gripping end of the lever tab, an outer top surface upon which an erasable marking surface is formed, and an under surface into which a retraction member opening is formed; the lever tab locking structure including a resilient locking prong retraction member and a curved locking prong; the resilient locking prong retraction member including a horizontal portion and a vertical portion; the horizontal portion extending into the retraction member opening formed into the under surface of the cover member; the vertical portion extending vertically away from the horizontal portion; the curved locking prong arching into the lever tab receiving cavity and away from the lever tab insertion opening; the resilient locking prong retraction member being bendable outwardly from the cover member sufficiently to withdraw the curved locking prong from the lever tab receiving cavity.

It is a still further object of the invention to provide a beverage can identification system that accomplishes one or more of the above objects in combination.

Accordingly, a beverage can identification system for identifying the owner of a beverage can having a beverage can top equipped with a lever tab with a gripping end having a gripping end tab aperture formed therein, and a securing rivet securing an affixed end of the lever tab to the beverage can top is provided. The beverage can identification system includes at least one identifier tab cover that is securable to the gripping end of the lever tab; the identifier tab cover including a molded plastic cover member and a lever tab locking structure; the molded plastic cover member having a lever tab insertion opening formed therein in connection with a lever tab receiving cavity sized to receive the gripping end of the lever tab, an outer top surface upon which an erasable marking surface is formed, and an under surface into which a retraction member opening is formed; the lever tab locking structure including a resilient locking prong retract on member and a curved locking prong; the resilient locking prong retraction member including a horizontal portion and a vertical portion; the horizontal portion extending into the retraction member opening formed into the under surface of the cover member; the vertical portion extending vertically away from the horizontal portion; the curved locking prong arching into the lever tab receiving cavity and away from the lever tab insertion opening; the resilient locking prong retraction member being bendable outwardly from the cover member sufficiently to withdraw the curved locking prong from the lever tab receiving cavity.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 3 is a top side, perspective view of the exemplary identifier tab cover of FIG. 1 in isolation showing the molded plastic cover member, the lever tab insertion opening in connection with the lever tab receiving cavity, and the erasable marking surface formed onto the top surface of the cover member.

FIG. 4 is an underside, perspective view of the exemplary identifier tab cover of FIG. 1 in isolation showing the lever tab insertion opening in connection with the lever tab receiving cavity; and the under surface of the molded plastic cover member including the horizontal and vertical portions of the resilient locking prong retraction member of the lever tab locking structure, the horizontal portion extending into the retraction member opening formed into the under surface of the cover member, the vertical portion extending vertically away from the horizontal portion.

EXEMPLARY MODE FOR CARRYING OUT THE INVENTION

Figure 1:
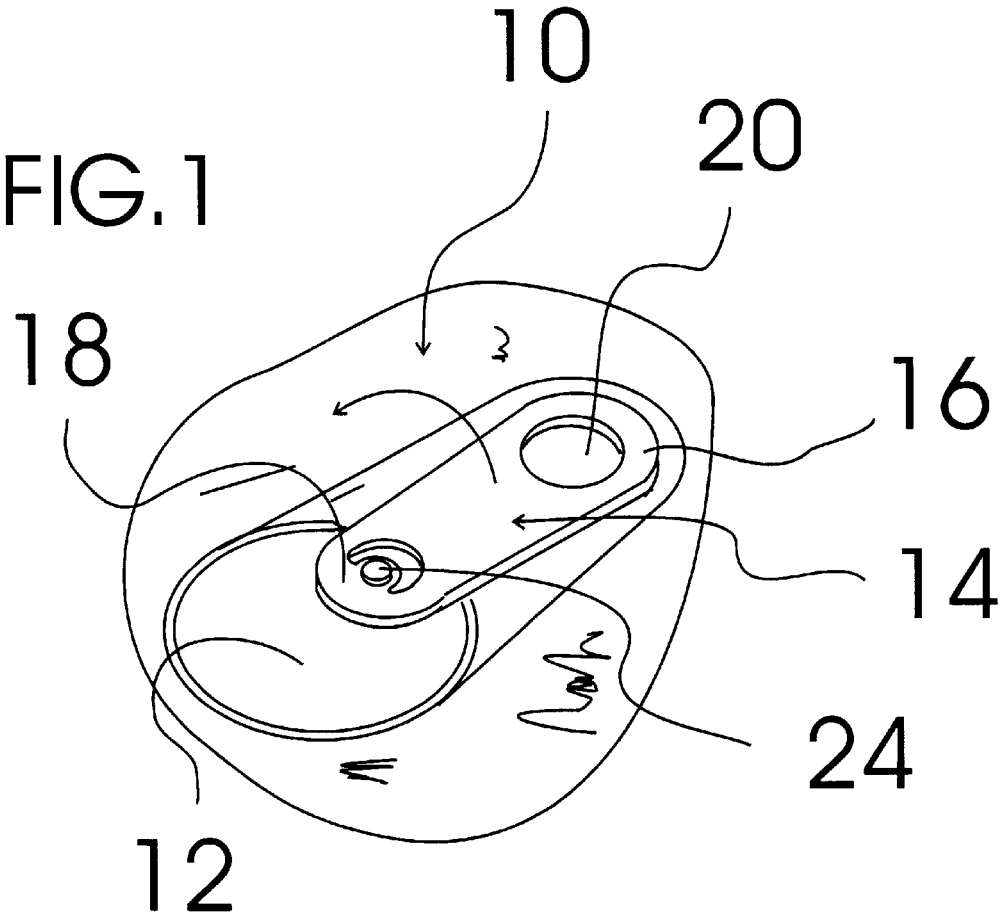
FIG. 1 is a detail perspective view of a representative beverage can top of the type with which the beverage can identification system of the present invention is used showing the pop-in portion of the beverage can top, the lever tab with the gripping end tab aperture, and the securing rivet securing the affixed end of the lever tab to the beverage can top.

FIG. 1 is a detail perspective view of a representative beverage can top, generally designated 10, with which the beverage can identification system of the present invention is used. Representative beverage can top 10 includes a pop-in portion 12 and a lever tab, generally designated 14, having a gripping end 16 and an affixed end 18. Gripping end 16 is provided with a gripping end tab aperture 20 to ease gripping. Affixed end 18 is affixed to can top 10 with a securing rivet 24. Lever tab 14 remains connected to can top 10 even after pop-in portion 12 is forced inward to open can top 10 by pulling on gripping end 16.

Figure 2:
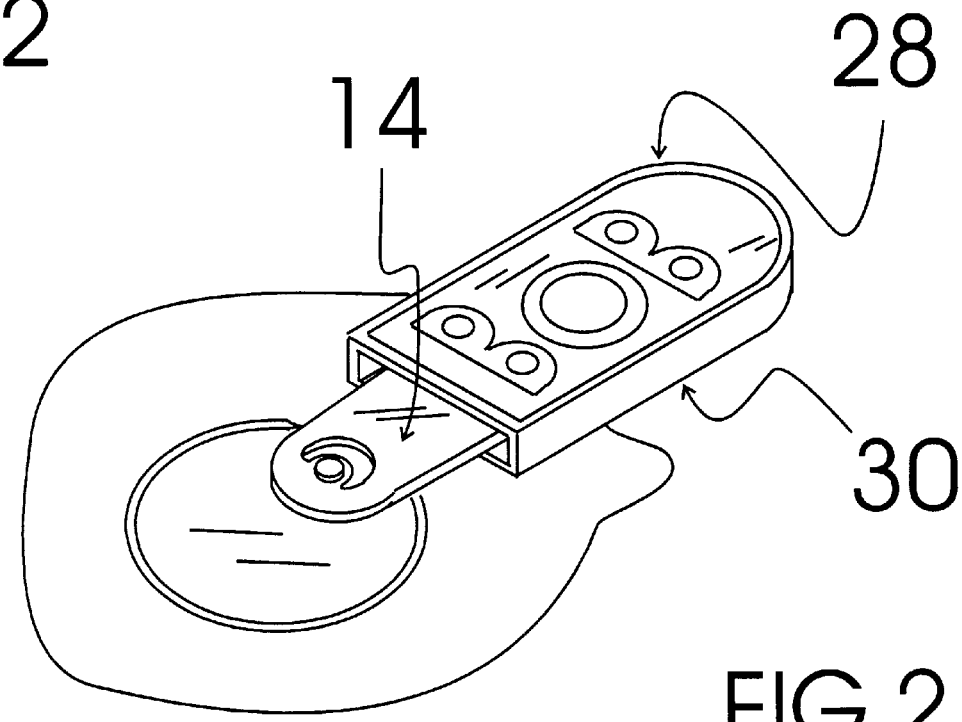
FIG. 2 is a detail perspective view showing the gripping end of the lever tab secured within an exemplary identifier tab cover of the beverage can identification system of the present invention.

With reference now to FIG. 2, in this embodiment, the beverage can identification system, generally designated 28, includes a number of identical identifier tab covers, generally designated 30 that are each securable to gripping end 16 (FIG. 1) of lever tab 14. Referring now to FIG. 3, each identifier tab cover 30 includes a molded plastic cover member, generally designated 32, having an enamel, erasable marking surface 36 formed onto a top surface 38 of molded plastic cover member 32. In use, the user can write an identifying word, such as a name, on erasable marker surface 36 to identify his/her beverage can. Molded plastic cover member 32 has a rectangular shapes lever tab insertion opening 40 in connection with a lever tab receiving cavity 42 formed into cover member 32 and sized to receive gripping end 16 (FIG. 1) of lever tab 14 (FIG. 2).

Referring now to FIG. 4, molded plastic cover member 32 also includes an under surface 44 through which a rectangular shaped retraction member opening 46 is formed into connection with lever tab receiving cavity 42. In this embodiment, identifier tab cover 30 includes a lever tab locking structure, generally designated 50, that includes a resilient locking prong retraction member, generally designated 52, that includes a horizontal portion 54 and a vertical portion 56. Horizontal portion 54 is rectangularly shaped, integrally formed with under surface 44 of cover member 32 and extends into and over retraction member opening 46 formed into under surface 44.

Figure 5:
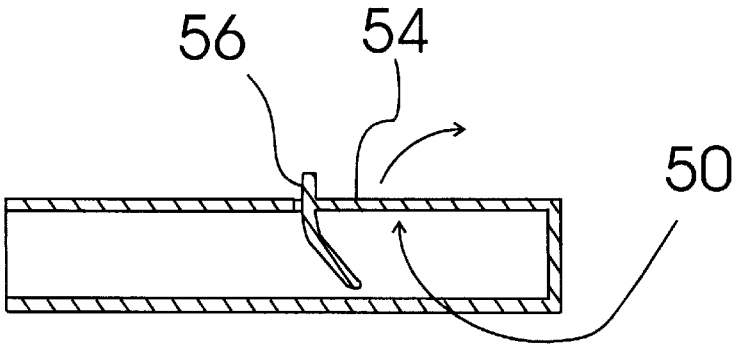
FIG. 5 is a cross sectional view of the identifier tab cover of FIG. 4 showing the lever tab insertion opening in connection with the lever tab receiving cavity, and the lever tab locking structure including the resilient locking prong retraction member and the curved locking prong, the curved locking prong arching into the lever tab receiving cavity and away from the lever tab insertion opening.
Figure 6:
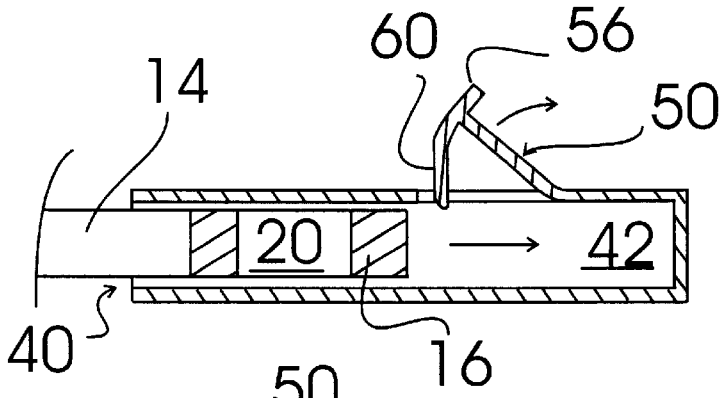
FIG. 6 is a cross sectional view of the identifier tab cover showing the resilient locking prong retraction member bent outwardly from the cover member; the locking prong withdrawn from the lever tab receiving cavity; and the gripping end of the lever tab inserted through the lever tab insertion opening and partially into the lever tab receiving cavity.
Figure 7:
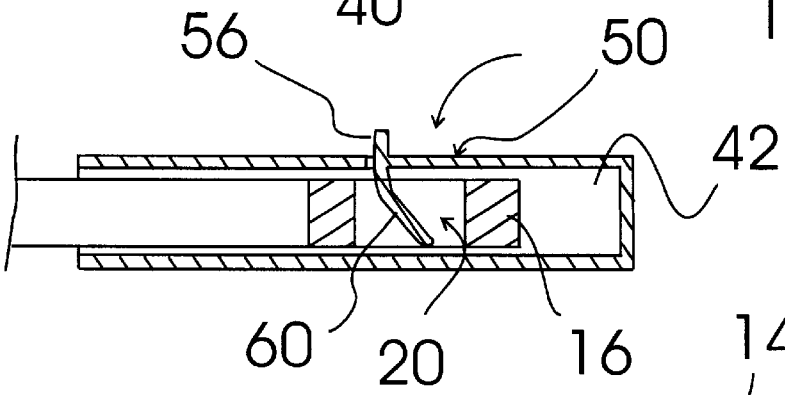
FIG. 7 is a cross sectional view of the identifier tab cover showing the gripping end of the lever tab fully inserted into the lever tab receiving cavity and the resilient locking prong retraction member in its normal resting position with the locking prong inserted into the gripping end tab aperture of the lever tab locking the gripping end of the lever tab within the lever tab receiving cavity.
Figure 8:
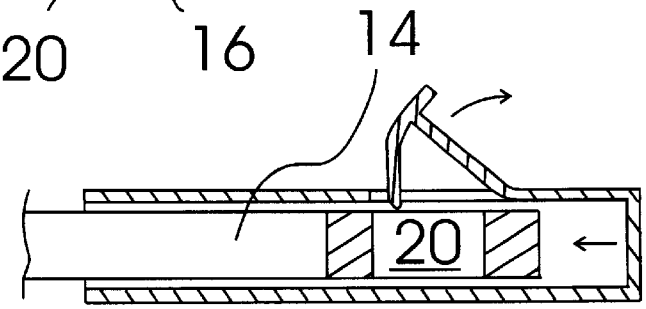
FIG. 8 is a cross sectional view of the identifier tab cover showing the resilient locking prong retraction member bent outwardly from the cover member and the locking prong withdrawn from the gripping end tab aperture of the lever tab prior to withdrawal of the gripping end from the lever tab receiving cavity.

With reference now to FIG. 5, vertical portion 56 extends vertically away from horizontal portion 54 at a right angle and provides a contact area for the finger of a user when, with reference now to FIG. 6, resilient locking prong retraction member 50 is bent outwardly to withdraw a curved locking prong 60 that is integrally formed with vertical portion 56 from lever tab receiving cavity 42 to allow gripping end 16 of lever tab 14 to be inserted through lever tab insertion opening 40 into lever tab receiving cavity 42. Referring to FIG. 7, once gripping end 16 is fully inserted into lever tab receiving cavity 42, vertical portion 56 is released. Resilient locking prong retraction member 50 then returns to a resting position wherein curved locking prong 60 is inserted through gripping end tab aperture 20 of gripping end 16 and into lever tab receiving cavity 42 to lock gripping end 16 within lever tab receiving cavity 42. Referring to FIG. 8, lever tab 14 is released from lever tab receiving cavity 42 by bending by resilient locking prong retraction member 50 outwardly to withdraw curved locking prong 60 from lever tab receiving cavity 42 and gripping end tab aperture 20.

It can be seen from the preceding description that a beverage can identification system has been provided that includes at least one identifier that can be removed from a beverage can and transferred to successive beverage cans as required; and that is used to identify the owner of a beverage can having a beverage can top equipped with a lever tab with a gripping end having a gripping end tab aperture formed therein, and a securing rivet securing an affixed end of the lever tab to the beverage can top wherein the beverage can identification system includes at least one identifier tab cover that is securable to the gripping end of the lever tab; the identifier tab cover including a molded plastic cover member and a lever tab locking structure; the molded plastic cover member having a lever tab insertion opening formed therein in connection with a lever tab receiving cavity sized to receive the gripping end of the lever tab, an outer top surface upon which an erasable marking surface is formed, and an under surface into which a retraction member opening is formed; the lever tab locking structure including a resilient locking prong retraction member and a curved locking prong; the resilient locking prong retraction member including a horizontal portion and a vertical portion; the horizontal portion extending into the retraction member opening formed into the under surface of the cover member; the vertical portion extending vertically away from the horizontal portion; the curved locking prong arching into the lever tab receiving cavity and away from the lever tab insertion opening; the resilient locking prong retraction member being bendable outwardly from the cover member sufficiently to withdraw the curved locking prong from the lever tab receiving cavity.

It is noted that the embodiment of the beverage can identification system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A beverage can identification system for identifying an owner of a beverage can having a beverage can top equipped with a lever tab with a gripping end having a gripping end tab aperture formed therein, and a securing rivet securing an affixed end of the lever tab to the beverage can top, the beverage can identification system comprising:

at least one identifier tab cover that is adapted to be secured to the gripping end at the lever tab;

said identifier tab cover including a cover member and a lever tab locking structure;

said cover member having a lever tab insertion opening formed therein in connection with a lever tab receiving cavity sized to receive the gripping end of the lever tab of the beverage can, an outer top surface, an erasable marking surface formed on said outer top surface, and an under surface having a retraction member opening formed therethrough;

said lever tab locking structure including a resilient locking prong retraction member and a curved locking prong;

said resilient locking prong retraction member including a horizontal portion and a vertical portion;

said horizontal portion extending into said retraction member opening formed through said under surface of said cover member;

said vertical portion extending vertically away from said horizontal portion;

said curved locking prong arching into said lever tab receiving cavity and away from said lever tab insertion opening;

said resilient locking prong retraction member being bendable outwardly from said cover member sufficiently to withdraw said curved locking prong from said lever tab receiving cavity.

2. The beverage can identification system of claim 1, wherein:

said cover member is formed of plastic.

3. The beverage can identification system of claim 2, wherein:

said cover member is molded.

4. The beverage can identification system of claim 3 wherein:

said under surface of said cover member is integrally formed with said horizontal portion of said resilient locking prong retraction member.

5. The beverage can identification system of claim 2 wherein:

said under surface of said cover member is integrally formed with said horizontal portion of said resilient locking prong retraction member.

6. The beverage can identification system of claim 1, wherein:

said cover member is molded.

7. The beverage can identification system of claim 6 wherein:

said under surface of said cover member is integrally formed with said horizontal portion of said resilient locking prong retraction member.

8. The beverage can identification system of claim 1 wherein:

said under surface of said cover member is integrally formed with said horizontal portion of said resilient locking prong retraction member.

* * * * *